US008074850B2

(12) United States Patent
Soderquist et al.

(10) Patent No.: US 8,074,850 B2
(45) Date of Patent: Dec. 13, 2011

(54) HOLSTER ASSEMBLY FOR INTEGRAL ATTACHMENT TO A GARMENT

(76) Inventors: Steven Allen Soderquist, Blaine, MN (US); Tony Thanh Vo, New Hope, MN (US)

( * ) Notice: Subject to any disclaimer, the term of this patent is extended or adjusted under 35 U.S.C. 154(b) by 1008 days.

(21) Appl. No.: 11/903,932

(22) Filed: Sep. 25, 2007

(65) Prior Publication Data

US 2008/0073393 A1 Mar. 27, 2008

Related U.S. Application Data

(60) Provisional application No. 60/847,171, filed on Sep. 26, 2006.

(51) Int. Cl.
*F41C 33/02* (2006.01)

(52) U.S. Cl. ..... 224/243; 224/250; 224/912

(58) Field of Classification Search ..... 224/193, 224/243, 24, 250, 912, 914, 244, 931
See application file for complete search history.

(56) References Cited

U.S. PATENT DOCUMENTS

| | | | | | |
|---|---|---|---|---|---|
| 309,292 | A | | 12/1884 | Browne | |
| 780,720 | A | | 1/1905 | Keeley | |
| 1,173,376 | A | * | 2/1916 | Noye | 224/230 |
| 1,191,339 | A | * | 7/1916 | Noye | 224/230 |
| 1,894,540 | A | * | 1/1933 | Peirce | 224/242 |
| 2,810,132 | A | * | 10/1957 | Nicholson | 2/247 |
| 3,769,733 | A | * | 11/1973 | Nelson | 42/89 |
| 3,865,289 | A | | 2/1975 | Boren | |
| 4,750,655 | A | | 6/1988 | Barry | |
| 5,215,238 | A | | 6/1993 | Baruch | |
| 5,517,696 | A | | 5/1996 | Krugler | |
| 5,570,830 | A | * | 11/1996 | Nichols | 224/676 |
| 5,632,426 | A | * | 5/1997 | Beletsky et al. | 224/243 |
| 5,692,237 | A | * | 12/1997 | Bennett | 2/93 |
| 5,820,003 | A | | 10/1998 | Nichols | |
| 5,839,630 | A | * | 11/1998 | Dunstan et al. | 224/197 |
| 6,089,432 | A | | 7/2000 | Gage et al. | |
| D437,998 | S | | 2/2001 | Williamson | |
| 6,467,660 | B1 | | 10/2002 | Rogers et al. | |
| 7,058,987 | B2 | | 6/2006 | Salazar | |

* cited by examiner

*Primary Examiner* — Justin Larson
*Assistant Examiner* — Adam Waggenspack
(74) *Attorney, Agent, or Firm* — Michael A. Mochinski

(57) ABSTRACT

A holster assembly for integral attachment to a garment of the type typically worn by individuals engaged in law enforcement and related activities. The holster assembly comprising a flexible backing member having an outer mountable surface for sewingly attaching thereto an intermediate backing member, which is capable of supporting and mounting thereon a pocket for receiving and accepting therein a rigid sleeve fitted interiorly with a Taser® device. The pocket is fabricated from a unified piece of material and shaped accordingly to distinctly define a frontal tapered member bounded by a right side member and a left side member integrally incorporating an outer extending flange. The pocket is further supported by and fitted with a base member connected along its leading edge to a bottom end of each side member, along a leading edge of the frontal tapered member, and to a lowermost portion of the intermediate backing member. A shortened sleeve strap is connected to a top end of the right side member, while a second end is connected to a portion of the rigid sleeve to assist in securing its position within the pocket. A lengthened strap member, which comprises an end mounted to the outer mountable surface and a second end temporally connected to an apex section of the outer mountable surface, slippingly engages over a lower handle portion of the Taser® device to further retain its position within the rigid sleeve.

20 Claims, 7 Drawing Sheets

HOLSTER ASSEMBLY FOR INTEGRAL ATTACHMENT TO A GARMENT

CROSS-REFERENCE TO RELATED APPLICATIONS

This application claims the benefit of U.S. Provisional Patent Application No. 60/847,171, filed Sep. 26, 2006, entitled "Holster Assembly for Integral Attachment to a Garment," the disclosures of which, including all attached documents, are incorporated herein by reference in their entirety for all purposes.

FIELD OF THE INVENTION

The present invention relates in general to a holster assembly that is selectively suited for integral attachment to a garment and capable of accepting and securely holding therein a holster sleeve associated with a non-lethal weapon, particularly in the form of a Taser® device commonly employed for use in law enforcement and related activities. More specifically, the holster assembly is strategically positioned on the garment of the type typically worn by law enforcement and security personnel to ensure predictable and reliable means for withdrawing the Taser® device during times of an emergency or in a crisis situation.

BACKGROUND OF THE INVENTION

As part of their official duties, law enforcement and security personnel must carry on themselves at all times many forms of official equipment for personal defense and restraint of apprehended persons. Typically, official equipment may comprise a collection of at least one lethal weapon in the form of a firearm, a set of handcuffs, pepper spray, nightstick, flashlight, radio, keys, gloves, and a whistle. Advancement in technology and public sentiment toward the use of deadly force by law enforcement officers and security personnel, however, has led to the development and use of a variety of non-lethal weapons, such as a Taser® device. Non-lethal weapons are largely complementary to existing lethal weapons and have not acted as a direct replacement therefor. The adaptation of the Taser® device in today's society largely adds to the present list of official equipment law enforcement personnel must carry during his or her undertaking of an official duty. Like a firearm, the Taser® device must be made readily accessible to a law enforcement officer whom is required to immediately act within his or her scope of official duties.

Individuals acting in their official capacity may commonly carry and hold the official equipment about and along their waistline by means of a belt or a similarly configured device. In order to provide for more secure containment of the official equipment, the belt may comprise an assortment of pouches and compartments specially configured for the equipment. The belt in this instance may supplementally serve in its recognized role or capacity to hold an individual's trousers about the waistline. Because of this dual purpose and recognizable functionality, these belts may become very heavy and discomforting to the wearer, particularly when it is loaded with official equipment. Because of the assortment of equipment one must carry and the weight associated therewith, the belt is typically fabricated from a heavy-weighted leather to ensure a more long durable life to its wearer.

As suggested above, the belt may comprise a number of individual pouches and compartments each being of a specific size and shape to adequately store the official equipment as exemplified above to ensure reliable accessibility thereto and mitigate risk of loss thereof. To make the official equipment generally more accessible to the wearer during his or her official duties, each pouch and compartment is preferably positioned about the belt's front and left and right sides. Placement of the pouches primarily on the front and left and right sides of the belt promotes an added benefit of comfort and safety during one's pursuit and undertaking of an official duty, such as sitting at a desk and driving an automobile.

The art recognizes that an individual involved in law enforcement and the like may have unique needs and requirements for holding and containing official equipment other than that of a belt described above, possibly to coincide with a specific duty or task associated with a particular job function or distribute the weight of the official equipment more about the wearer for increased comfort. Other supplementary devices serving in the capacity to store and contain official equipment about an individual may include a vest, a handbag, a shoulder bag, a waist bag, and a hip- or leg-mounted holster. Notwithstanding the viability of these supplementary devices for containing official equipment, each may comprise a unique advantage and disadvantage central to the aspect of concealment, wearer's comfort, and ability to gain quick and easy access to the official equipment during an emergency or in a crisis situation.

Vests come in a variety of shapes and forms to serve unique needs and requirements of an individual involved in law enforcement. A vest configured for wear underneath an outer garment like a shirt or jacket may further serve in concealing official equipment such as a firearm, while a vest configured for outer wear may promote convenience and ready access to the official equipment, but unduly compromising an often needed function of concealment. Regardless of the configuration, an added layer of clothing can promote a distinct disadvantage, particularly in hot weather, where a wearer's body temperature may unacceptably increase during engagement of a strenuous activity. To regulate body temperature, the wearer may be required to remove the vest temporarily from time to time, which may compromise its continued functionality and possibly increase risk of loss of the official equipment. In similar respects, particularly in cold weather, an individual may be required to wear a vest over a heavy winter coat or similar garment. The transition between outdoor and indoor environments may be a challenge especially if the official equipment stored within and on the vest needs to be accessible to the wearer at all times. Depending on the working conditions, a great number of outdoor to indoor and indoor to outdoor environmental transitions may be required during a typical workday, which consequently increases the number of times the vest must be repositioned about the wearer to sustain an acceptable level of climatic comfort.

A handbag, shoulder bag and waist bag each equally serve as adequate means for containing and storing official equipment required of law enforcement and security personnel. A handbag, for instance, may be configured for effective containment of the official equipment by comprising a variety of specially shaped compartments, but its use preoccupies a law enforcement officer's hand. Depending upon the circumstances, a law enforcement officer may be at a significant disadvantage if one or both hands are not free and available for use during an undertaking of an official duty. Additionally, since the handbag is not connected to the uniform in any physical manner, but to the individual, there may be an opportune moment for misplacement of the handbag during a momentary relief of duty.

Likewise, a shoulder bag may equally serve in the capacity to contain and carry the official equipment. However, since the shoulder bag is not integral to a law enforcement officer's uniform, it may also present an opportunity for misplacement. In further respects, straps or a harness assembly often associated with the shoulder bag by design may inadvertently catch passing objects or serve as effective means for grabbing the shoulder bag and retrieving the official equipment from a law enforcement officer by another, possibly by a perpetrator of a crime in pursuit. Moreover, the straps or the harness assembly may unacceptably serve as means for grabbing and leveraging down the law enforcement officer in an uncompromising position during a close combat situation. In either event, the availability of the official equipment for use by the law enforcement officer is unduly compromised and appreciably diminished during the line of duty.

A waist bag, like that of a shoulder bag, may equally serve in carrying and storing official equipment. However, a bag of this type may share the same location of the belt described above with its own number of compartments, which may lessen the overall effectiveness thereof for full and complete access to the official equipment or unacceptably increase the weight along and about the waistline. Like the positioning of compartments integrally attached to a belt, the waist bag will be positioned about the front or side waistline of an individual to permit convenient access to the official equipment and to enhance comfort during performance of an official task such as sitting and driving an automobile.

A holster may be regarded as the most common compartmental means for carrying official equipment by a law enforcement officer, but tends to be selectively directed for a specific use or application. The challenge is that the vast majority of traditional holsters are designed for carrying conventional firearms and not non-lethal weapons, notably a Taser® device. Their basic structure makes them useful for carrying a firearm in a manner that allows for quick access and retrieval thereof by the law enforcement officer. The most challenging aspect of holster use is balancing the need for securing and containing the firearm to prevent inadvertent misuse and providing quick and immediate access thereto during a crisis situation. Traditional holsters tend to be fabricated from a heavy-weighted leather, like that of the belt described above, and are worn and connected to an individual's hip or waistline, typically by means of a supplementary belt. Most individuals are either left- or right-hand dominant requiring placement of the firearm holster on the corresponding left or right side hip. Placement of the firearm holster about the hip, regardless of orientation, leaves little to no space for additional compartmental storage for other official equipment like that of the Taser® device. Nonetheless, the art recognizes that the holster may alternatively be placed and positioned about an individual's lower leg to retain compartmental storage about one's hip, as particularly described above, while permitting effective concealment of the firearm underneath a pant leg. As with this configuration, however, an individual's capacity or ability to effectively withdraw a lethal or non-lethal weapon during an emergency or in a crisis situation may appreciably diminish to an unacceptable level.

Accordingly, there remains a need for a holster assembly suited for integral attachment to a garment and comprises compartmental storage for secure containment of a holster sleeve and an accompanying non-lethal weapon, such as a Taser® device, about an individual that primarily affords convenient and immediate access thereto during an emergency or in a crisis situation, yet retains a level of comfort to the wearer and fulfills the ability to carry other forms of official equipment about the waistline, possibly by means of a belt integrally equipped with pouches and compartments or a waist bag.

BRIEF SUMMARY OF THE INVENTION

In order to overcome the numerous drawbacks apparent in the prior art, a holster assembly for integral attachment to a garment for which is suited to contain and carry a holster sleeve and an accompanying non-lethal weapon in the form of a Taser® device has been devised.

It is an object of the present invention to provide a holster assembly for integral attachment to a garment that is principally suited for individuals involved in law enforcement and related activities.

It is another object of the present invention to provide a holster assembly for integral attachment to a garment that diminishes the need for supplementary storage devices, such as bags directed for use with an individual's hand, shoulder or waist, a vest, and leg- and hip-mounted holsters, collectively of which may hinder an individuals's ability to immediately act and fulfill his or her scope of official duties.

It is yet another object of the present invention to provide a holster assembly for integral attachment to a garment that complements the functionality of a belt integrally equipped with pouches and compartments, commonly of the type used by individuals involved in law enforcement and related activities.

It is yet another object of the present invention to provide a holster assembly for integral attachment to a garment that is strategically positioned about the garment to allow convenient, quick and efficient access to or removal of a Taser® device during an emergency or in a crisis situation and mitigate occurrence of confusion with other forms of weapons that may be simultaneously carried by law enforcement personnel.

It is yet another object of the present invention to provide a holster assembly for integral attachment to a garment that serves to distribute the assortment of official equipment an individual must carry during performance of his or her official duties.

It is yet another object of the present invention to provide a holster assembly for integral attachment to a garment that affords secure containment of a Taser® device to mitigate risk of loss or unintentional or inadvertent removal thereof.

It is yet another object of the present invention to provide a holster assembly for integral attachment to a garment that securely and safely contains the Taser® device and cooperates with the functionality of its dedicated holster or rigid sleeve to reduce the risk of unwanted or unintentional firing, discharge or deployment of the Taser® device during an individual's undertaking of an official duty.

In accordance with the present invention, a holster assembly has been devised for attachment to a garment of the type typically worn by individuals engaged in law enforcement and related activities, the assembly comprising a flexible backing member having an outer mountable surface for sewingly attaching thereto an intermediate backing member, the intermediate backing member being suitably configured to support and mount a pocket for receiving and accepting therein a rigid sleeve associated with a non-lethal weapon, particularly in the form of a Taser® device, the pocket being fabricated from a unified piece of material and shaped accordingly to define a frontal tapered member bounded by a right side member and a left side member integrally incorporating an outer extending flange, the right side member and an exterior perimeter portion of the outer extending flange selectively serving as a location for sewingly attaching the pocket to the intermediate backing member, the pocket being supplementally supported by and fitted with a base member connected along its leading edge to a bottom end of each side member, along a leading edge of the frontal tapered member, and to the intermediate backing member, the left side member generally comprising a length of shorter dimension than that of the right side member to form and define a pitched opening suited to receive therethrough the rigid sleeve commonly associated with containing and holding the Taser® device; a shortened sleeve strap having one end affixed to a top end of the right side member and another end for attachment with a portion of the rigid sleeve to assist in securing its position within the pocket; and a lengthened strap member having one end mounted to the outer mountable surface, substantially positioned above the outer extending flange a predetermined distance, and a second end for temporal connection with an appropriate snap fastener positioned near an apex section of the outer mountable surface, the lengthened strap member being purposefully configured to slippingly engage over a lower handle portion of the Taser® device to further retain its position within the rigid sleeve.

Other objects, features, and advantages of the present invention will become apparent in the following detailed description of the preferred embodiments thereof when read in conjunction with the accompanying drawings in which like reference numerals depict the same parts in the various views.

BRIEF DESCRIPTION OF THE DRAWINGS

A preferred embodiment of the present invention will now be described by way of example with reference to the accompanying drawings, in which.

DETAILED DESCRIPTION OF THE INVENTION

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

Figure 1:
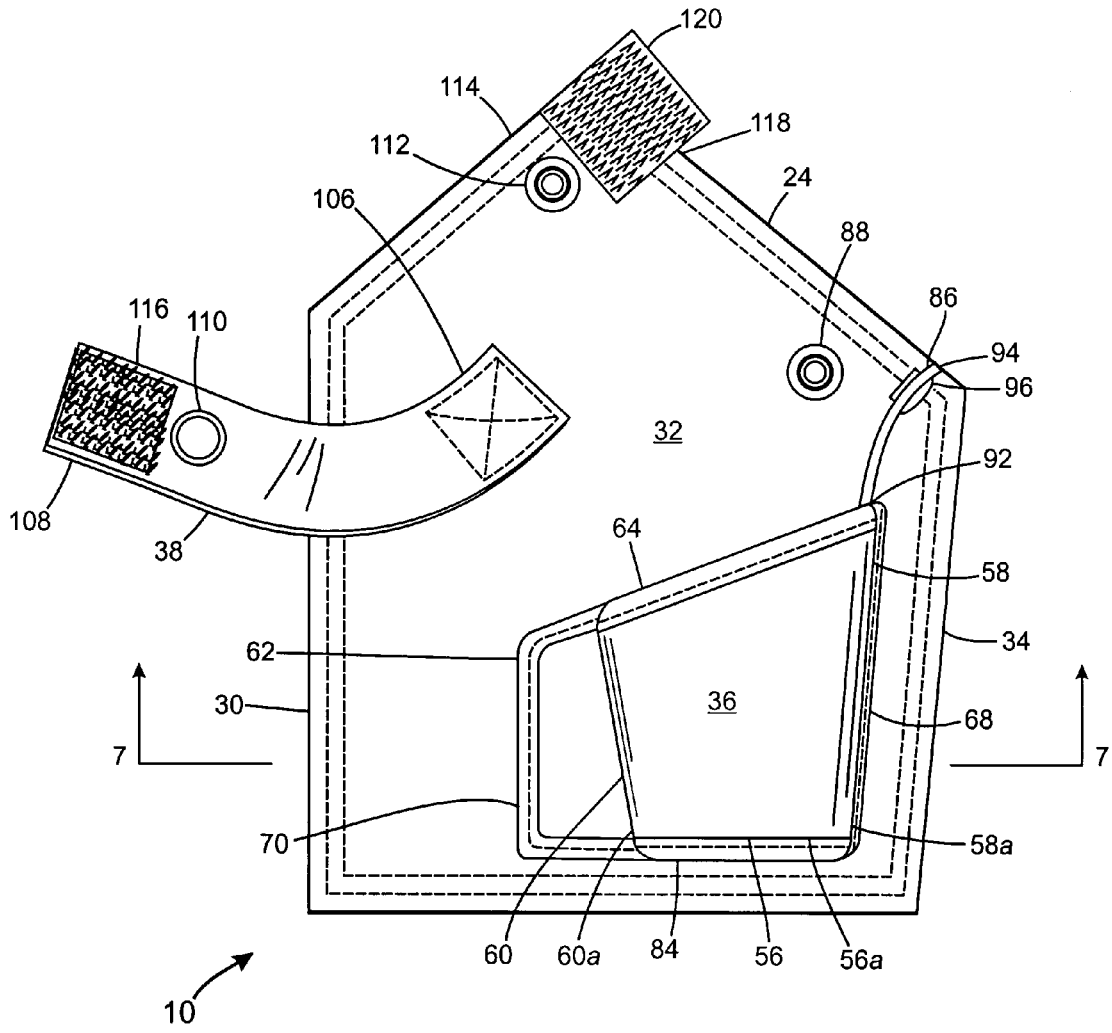
FIG. 1 is a front view of the preferred embodiment of the present invention illustrating a holster assembly fitted with a pocket mounted below a lengthened strap member used to engage a lower handle portion of a Taser® device.

Referring now to FIG. 1, there is generally shown at 10 a holster assembly for integral attachment to wearing apparel typically worn by individuals engaged in law enforcement and related activities. It is worthy to note that the holster assembly as depicted and described herein is configured for right hand use. It is well understood and recognized that the holster assembly may be suitably altered and configured in such respects to permit compatible operation with a wearer having a left hand preference or dominating characteristic. The preferred wearing apparel, as exemplified in FIG. 2 and typified in the art, is a pair of trousers or a pant garment 12 generally comprising two pant legs 14 integrally attached to a waist section 16 fitted with a plurality of upper positioned pockets 18 along right and left sides 20, 22 thereof. It is duly noted herein that the holster assembly described below in more detail is suited for attachment to a variety of garment types, including, but not limited to, outer wearable garments such as a vest, a jacket, a sweater, a jumpsuit, and a coat, and inner wearable garments such as a shirt and a sleeveless vest.

Figure 3:
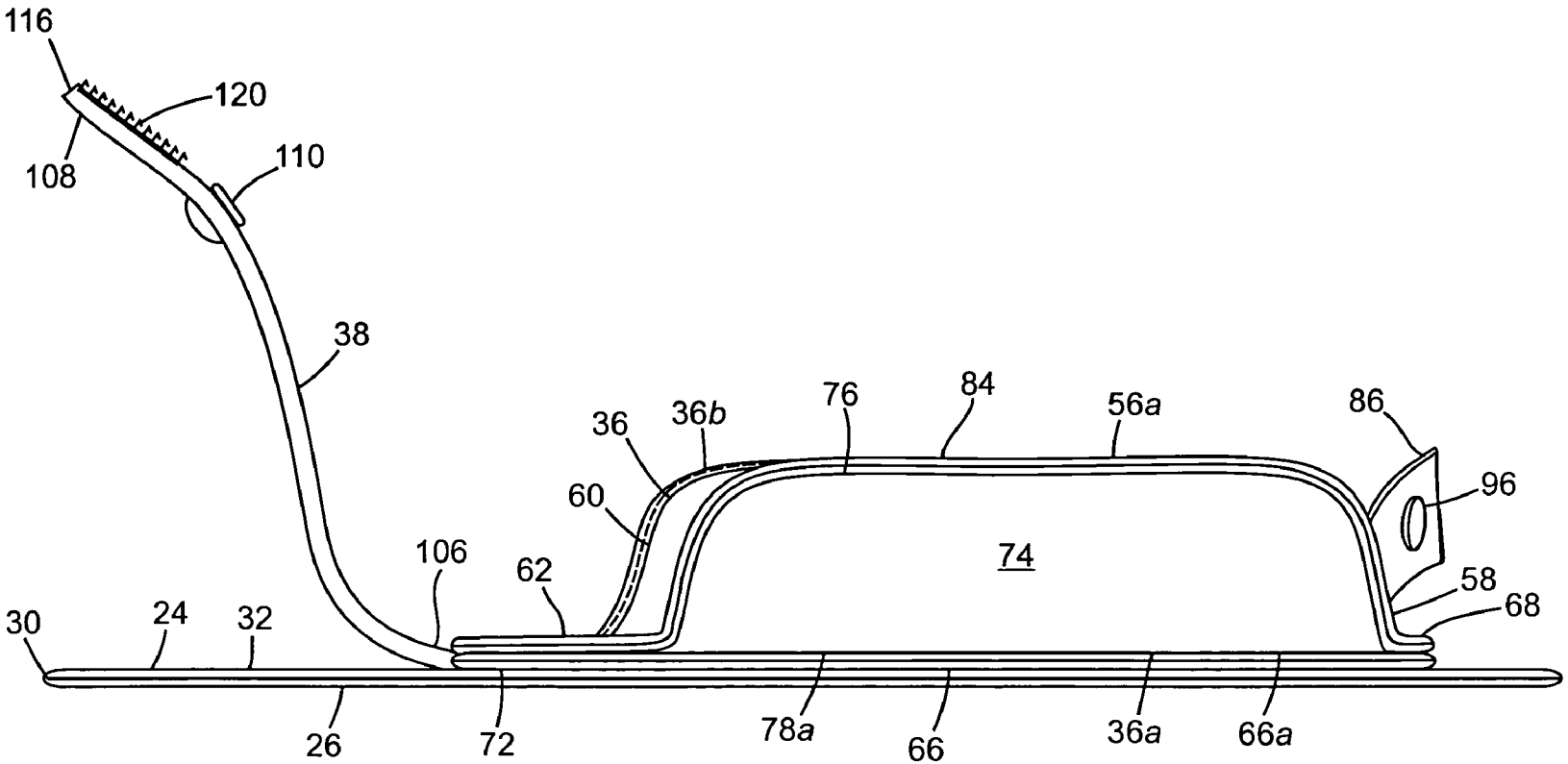
FIG. 3 is a bottom elevational view of the preferred embodiment of the present invention illustrating a lengthened strap member attached to a flexible backing member and a pocket attached to an intermediate backing member.
Figure 4:
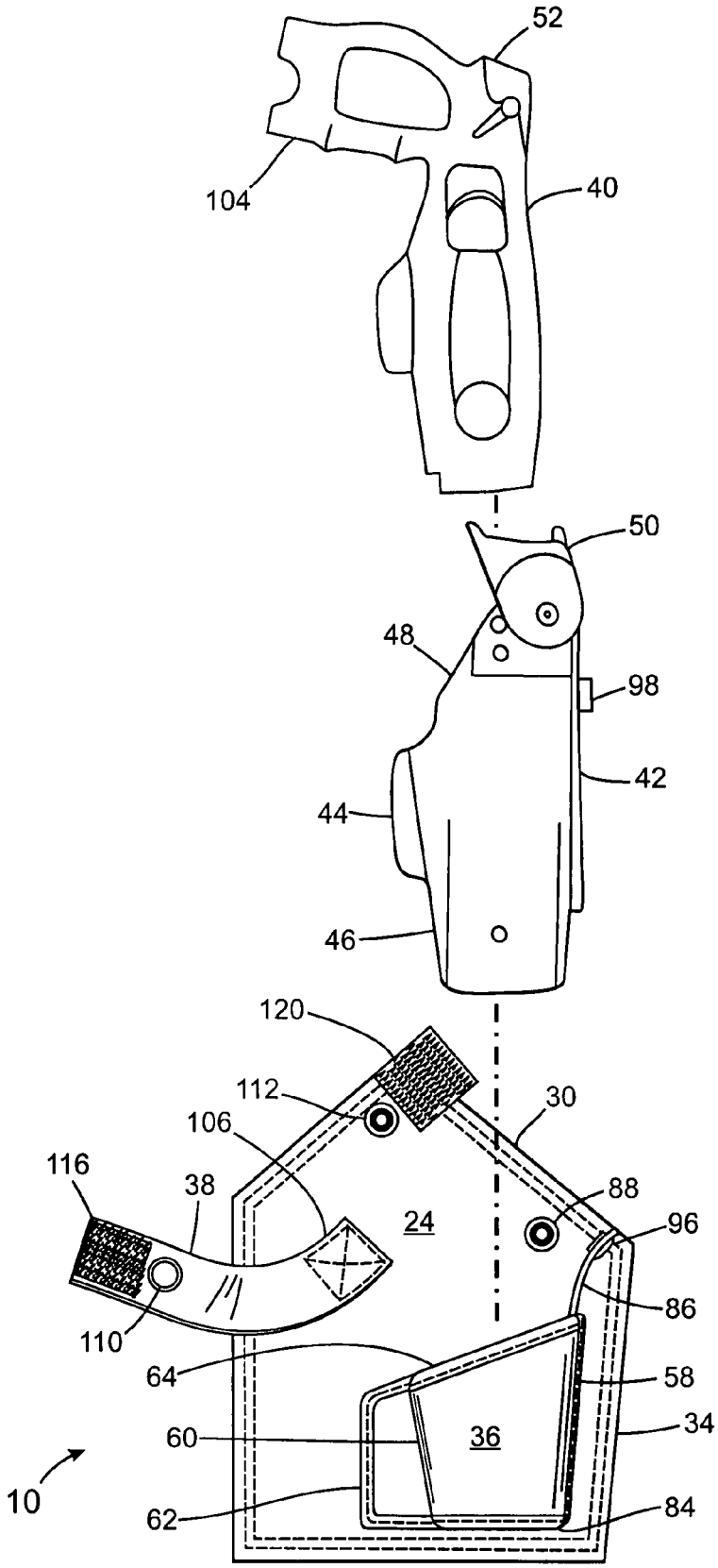
FIG. 4 is a front elevational view of the preferred embodiment of the present invention illustrating a holster assembly for receiving a rigid sleeve suited to hold and contain therewithin a Taser® device.
Figure 5:
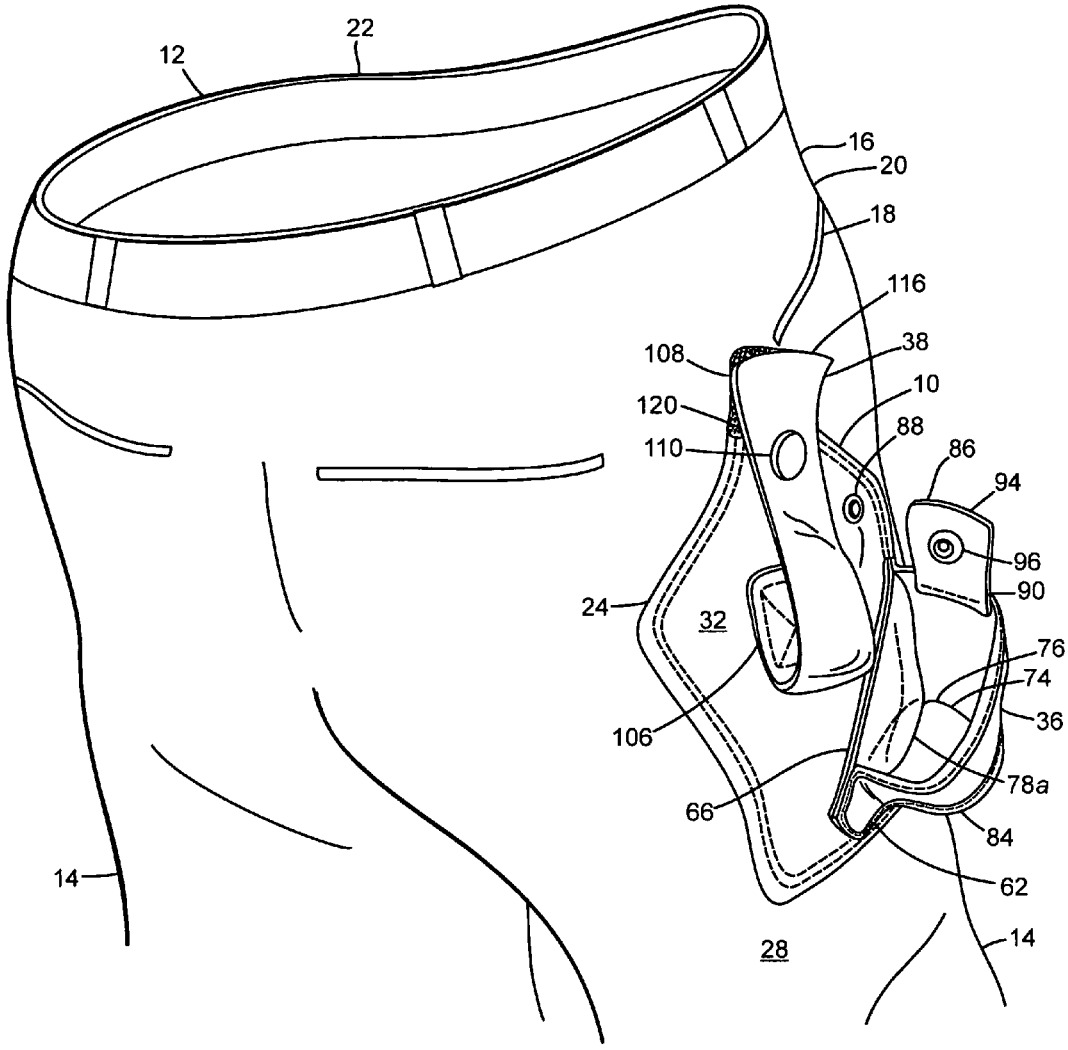
FIG. 5 is a side perspective view of a preferred embodiment of the present invention illustrating a holster assembly integrally attached to a right pant leg of a pant garment.
Figure 6:
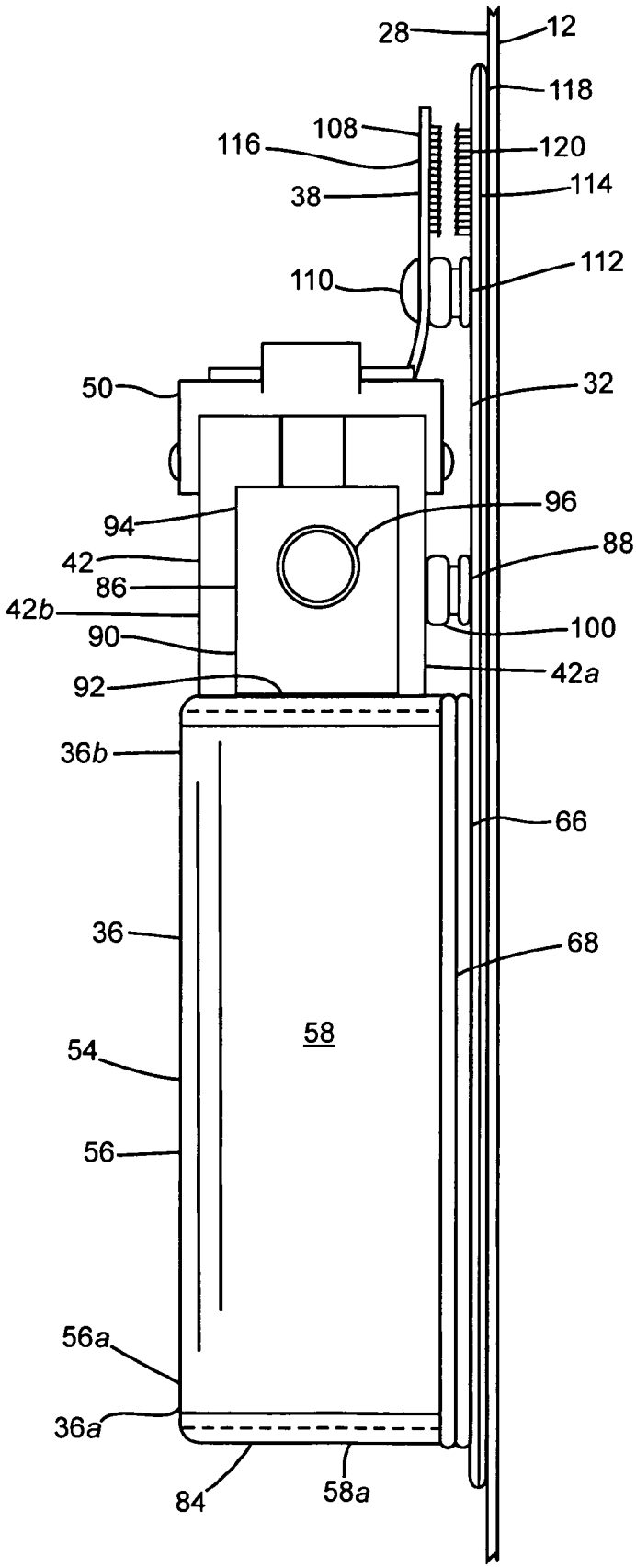
FIG. 6 is a side elevational view of the preferred embodiment of the present invention illustrating an intermediate backing member attached to a flexible backing member and fitted with a pocket for accepting and holding therein a rigid sleeve specifically associated with and configured for holding a Taser® device.

The holster assembly 10, as shown in FIGS. 1 and 3, preferably comprises a flexible backing member 24 having an inner facing surface 26 for engagement with an exterior surface portion 28 of the garment. An outer leading edge 30 of the flexible backing member is selectively folded therealong in an underlying manner to engage the inner facing surface prior to being sewingly attached therealong to the garment's exterior surface portion, purposefully to mitigate any occurrence of fraying or unraveling of the outer leading edge which may unacceptably establish premature failure of the holster assembly. It may be appropriate in some applications to supplement attachment of the flexible backing member to the garment by means of sewn thread arranged in a general cross-stitched pattern about the entire area of the flexible backing member 24 to mitigate buckling thereof. Other acceptable or alternative means for attaching the flexible backing member to the garment may comprise application of an adhesive, a hook and loop fastener such as Velcro®, or equivalents thereof to the inner facing surface 26 or placement of a plurality of rivets or equivalents thereof along the outer leading edge 30, substantially in the location desired for the sewn thread. In the preferred embodiment, the flexible backing member 24 is fabricated from an equivalent material generally used in fabricating the garment to retain the overall aesthetic qualities of the garment, particularly where the garment is fashioned as part of a uniform for law enforcement personnel. However, in other instances, it may be desirable to configure and construct the flexible backing member from other materials having greater tensile strength, such as a heavy-weighted Nylon® or a light-weighted leather, to ensure greater durability for more productive, lengthened use of the holster assembly 10 or a different fabric pattern or color to particularize the location of the holster assembly for greater visual identity, possibly to facilitate retrieval of a non-lethal weapon based on visual identification rather than on the basis of feel. The flexible backing member 24 is further shown in FIG. 1 to comprise an outer mountable surface 32 and plurality of sides 34 generally of unequal length to form and geometrically define a pentagonal shape, a shape of which permits even conformance thereof to the garment's shape and specific contours and to accommodate permanent attachment and the spatial requirements for a pocket 36 and a lengthened strap member 38 collectively used to hold and secure the non-lethal weapon, notably a Taser® device 40 of the type appreciably known in the art and as shown in FIG. 4. The pocket, as illustrated in FIG. 5, is geometrically configured to coincide with the proportions and shape of a holster or a rigid sleeve 42 commonly associated with holding and containing therewithin the Taser® device and as generally offered by the manufacturer of the Taser® device. The rigid sleeve 42, as depicted herein for exemplarily purposes and as known in the art, comprises back and front sides 42*a*, 42*b* integrally connected to first and second sideward members 42*c*, 42*d* to collectively form a receptacle 44 for receiving therein the non-lethal weapon, generally of which is supplemented by a tapered end section 46 and an upper slanted opening 48 for accepting and passing therethrough a portion of the Taser® device. A locking mechanism 50 pivotally attached near the upper slanted opening serves to slidably engage over an upper handle portion 52 of the Taser® device to retain the secure positioning of the Taser® device 40 within the rigid sleeve during non-use, substantially in the manner shown in FIG. 6.

Figure 7:
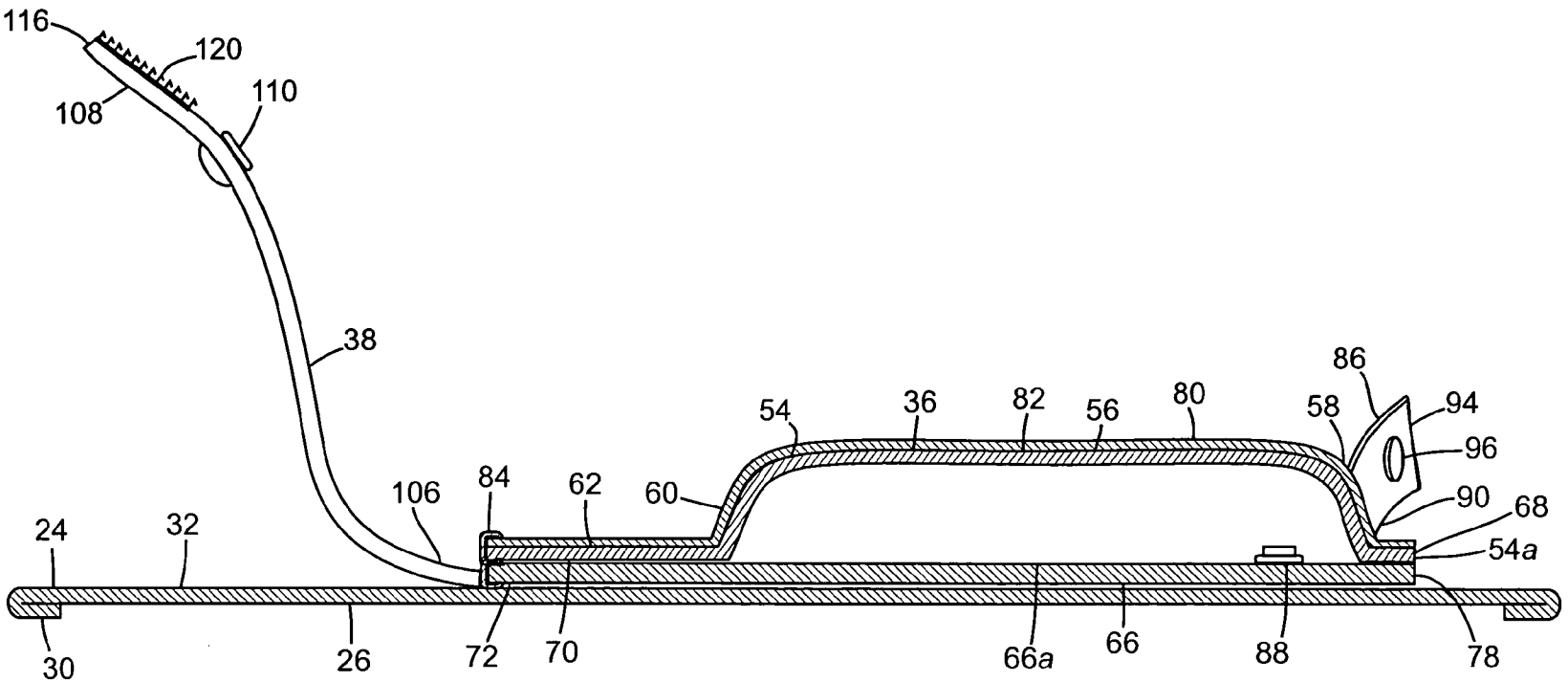
FIG. 7 is a cross sectional view of the preferred embodiment of the present invention taken on line 7-7 of FIG. 1 illustrating a lengthened strap member and a pocket mounted to an intermediate backing member collectively attached to a flexible backing member.

Referring now to FIG. 7, the pocket is preferably fabricated from a unified piece of material 54 selectively formed to define a frontal tapered member 56 bounded on each side thereof by a right side member 58 and a left side member 60 integrally incorporating an outer extending flange 62. As generally depicted in FIG. 1, the left side member 60 comprises an effective length of shorter dimension than that of the right side member 58 and is angularly pitched inward at its bottom end 60*a* a predetermined amount toward a bottom end 58*a* of the right side member, which structurally defines a pitched opening 64 at an upper end 36*a* of the pocket 36 to permit unrestricted access to the Taser® device 40 contained within the rigid sleeve. The pocket 36 is preferentially attached to an intermediate backing member 66 by means of sewn thread, particularly along a back leading edge 68 of the right side member and along an exterior perimeter portion 70 of the outer extending flange 62 that positionally coincides and aligns with a leftward perimeter portion 72 of the intermediate backing member. A base member 74, as shown in FIG. 3, supplements the overall structure of the pocket and is sewingly connected along its entire leading edge 76 to each of the bottom ends 58*a*, 60*a* of the side members, to a leading lower edge 56*a* of the frontal tapered member 56, and to a lowermost portion 78*a* of a leading edge 78 of an intermediate backing member 66. The outer extending flange in this configuration supplementally serves to reinforce the strength of the pocket 36 so that it may acceptably withstand the periodic placement and removal of the Taser® device from the holster assembly 10, while the intermediate backing member 66 serves to partially construct the pocket and suffice as a supplemental surface for securing the pocket to the flexible backing member 24 by means of sewn thread generally arranged in a cross-stitched pattern about its outer surface 66*a* and along its leading edge 78. Both the pocket 36 and intermediate backing member, each structurally forming part of the holster assembly 10, are preferably fabricated from a heavy-weighted material like that of Cordura®, particularly of a material type possessing the capacity to withstand the application of tensile forces and retain the preferential shape of the pocket over prolong use of the holster assembly. In the instance where a heavy-weighted material is used in fabricating the pocket, such as shown in FIG. 7, a fabric covering 80, generally coinciding with the fabric type selectively suited for the garment, may be applied to the pocket's exterior surface 82, principally to retain the overall aesthetic qualities of the garment. It may be appropriate in some applications to fixedly attach the fabric covering to the exterior surface 82 by means of sewn thread arranged in a general cross-stitched pattern or by an application of a suitable fabric adhesive to mitigate buckling thereof and enhance the overall structural integrity of the pocket 36. In order to mitigate any occurrence of fraying and unraveling of the materials used to construct the pocket and intermediate backing member 66, which may unduly hinder performance of and prematurely deteriorate the holster assembly 10, the leading edge 78 of the intermediate backing member and a leading edge 54*a* of the unified piece of material 54, except where the right side member 58 incidentally joins the intermediate backing member, each receive an edge treatment 84 that is folded along and over thereabout and sewingly connected therewith thread, typically in the manner shown in FIG. 7. The edge treatment particularly applied to the leading edge of the unified piece of material may supplementally or alternatively support the positioning of the fabric covering about the pocket in the instance where sewn thread or an adhesive is or is not used on the exterior surface 82, respectively.

In fulfilling secure retention of the rigid sleeve within the pocket 36, the present invention contemplates combined usage of a shortened sleeve strap 86 with connecting means and a snap button 88 positioned and attached to the outer mountable surface 32 of the flexible backing member. The shortened sleeve strap preferably comprises a first end 90 sewingly affixed to a top end 92 of the right side member and a second end 94 configured with connecting means, primarily comprising a mating snap button 96 of suitable configuration to engage with a snap button 98 mounted to the first sideward member 42*c*, generally in a location opposite the upper slanted opening 48, near and below the locking mechanism 50 of the rigid sleeve 42. The snap button 88 selectively dedicated to the outer mountable surface likewise functions to engage a mating snap button 100 mounted to the back side 44*a* of the rigid sleeve, adjacent to the locking mechanism, as substantially depicted in FIG. 6.

Referring now to FIGS. 1 and 7, the lengthened strap member 38 is preferably shown to comprise a first end 106 sewingly attached to the outer mountable surface 32 of the flexible backing member, generally above the outer extending flange to coincide with the positioning of the Taser® device, and an opposite, second end 108 fitted with a mating snap button 110 for engagement with a snap button 112 mounted to an apex section 114 of the outer mountable surface, a structure of which supplementally serves to retain the position of the Taser® device within the rigid sleeve 42 during temporal non-use thereof along with that of the locking mechanism 50. As shown in FIG. 1, the second end 108 bearing snap button 110 is preferably position positioned away from the second end of the lengthened strap member 38 a predetermined distance to form and structurally define a strap release 116. The strap release selectively functions in this capacity as means for permitting the wearer to readily grasp the lengthened strap member and leverage the release of the mating snap button 110 from the snap button 112 of the apex section prior to exercising retrieval of the Taser® device 40 from the rigid sleeve that is tightly held within the pocket 36. The strap release and an uppermost area 118 of the apex section 114, adjacent to the snap button suited to engage with the snap button of the lengthened strap member 38, may be supplementally configured with a hook and loop fastener 120 such as Velcro® to tightly adhere the strap release to the holster assembly 10 to further mitigate its entanglement or interference with the Taser® device during use thereof.

Figure 2:
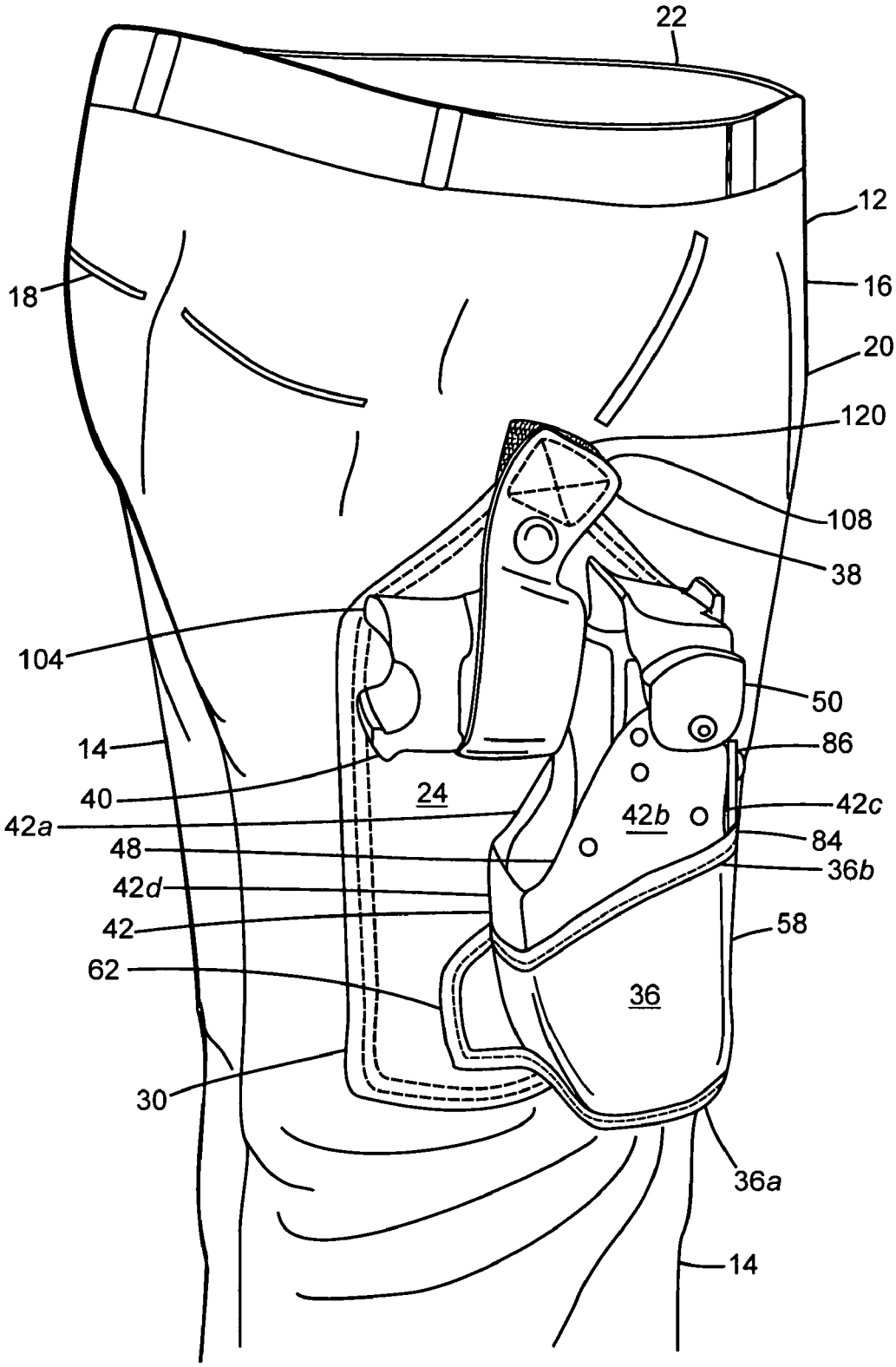
FIG. 2 is a front perspective view of the preferred embodiment of the present invention illustrating a holster assembly attached to a right pant leg of a pant garment, below a waistline thereof.

It can be seen from the foregoing that there is provided in accordance with this invention a simple and easily operated device, which is particularly suited for attachment to a garment typically of the type worn by individuals engaged in law enforcement and related activities. As shown in FIGS. 2 and 5, the holster assembly is preferentially mounted to the trouser or pant garment 12 below the pockets 18 of the either the right or left side 20, 22 along the pant leg 14, a mountable position of which substantially depends on the preferences of the wearer. In some instances, the wearer may preferentially mount the holster assembly 10 on the opposite left pant leg 14 for one being right hand dominant to possibly increase his or her access to the Taser® device at moment's notice or mitigate confusion with other weapon types notably carried by the wearer. In this particular configuration, the holster assembly may be angularly situated relative to the longitudinal axis of the left pant leg 14 whereby the pitched opening 64 of the pocket is positioned more rightward than the base member 74, substantially facing angularly and upwardly toward the wearer's right side waistline 20.

Regardless of orientation, the holster assembly 10 is completely functional in terms of sufficing as compartmental storage for a non-lethal weapon in the form of a Taser® device 40 commonly utilized in law enforcement activities, while simultaneously serving as means for lessening the weight at and along the waistline to increase the wearer's comfort during performance of an official duty. It is obvious that the components inherently made part of the holster assembly 10 may be fabricated from a variety of material types, providing such selection or use of materials suitably possesses the capacity to withstand forces acting thereon throughout its duration of use in a law enforcement setting. Accordingly, it is most desirable, and therefore preferred, to construct the pocket 36 and intermediate backing member 66 from a heavy-weighted material like that of Cordura® to establish adequate support for the Taser® device and rigid sleeve 42. To retain the overall aesthetic appearance of the garment, particularly in the instance where the garment is fashioned as part of a uniform for law enforcement or security personnel, the pocket's exterior surface may be outfitted with a fabric covering 80 that coincides with the fabric type used for the garment and flexible backing member 24.

While there has been shown and described a particular embodiment of the invention, it will be obvious to those skilled in the art that various changes and alterations can be made therein without departing from the invention and, therefore, it is aimed in the appended claims to cover all such changes and alterations which fall within the true spirit and scope of the invention.

What is claimed is:

1. A holster assembly for holding a non-lethal weapon on a garment, said assembly comprising, in combination:

a flexible backing member having an outer mountable surface and an inner facing surface positionally orientated to engage with the garment;

a rigid sleeve having back and front sides integrally connected to first and second sideward members to collectively form a receptacle for receiving therein the non-lethal weapon, the rigid sleeve having connecting means located on the first sideward member;

a pocket having a geometric configuration substantially suited for receiving therein said rigid sleeve and left and right side members each being fixedly attached to said outer mountable surface; and a shortened sleeve strap having a first end fixedly attached to said right side member and a second end, said second end of the shortened sleeve strap having connecting means capable of mating with the connecting means on said first sideward member of the rigid sleeve; said outer mountable surface comprises an apex section having a snap button and a hook and loop fastener each attached thereto; and a lengthened strap member having a first end fixedly attached to said outer mountable surface and a second end having a mating snap button fixedly attached thereto to snappingly engage and mate with said snap button of the apex section.

2. An assembly as set forth in claim 1, wherein said connecting means comprises a snap button fixedly attached to said first sideward member of the rigid sleeve and a mating snap button fixedly attached to said second end of the shortened sleeve strap to snappingly engage and mate with said snap button of the first sideward member.

3. An assembly as set forth in claim 1, wherein said rigid sleeve comprises a locking mechanism situated in vicinity of said connecting means.

4. An assembly as set forth in claim 1, wherein said rigid sleeve comprises a tapered end section and an upper slanted opening for accepting and passing therethrough the non-lethal weapon.

5. An assembly as set forth in claim 1, wherein said second end of the lengthened strap member comprises a strap release having a hook-and-loop fastener attached thereto to lock and engage with said hook-and-loop fastener of the apex section.

6. An assembly as set forth in claim 1, further comprising an intermediate backing member fixedly attached to said flexible backing member and having a leftward perimeter portion and a leading edge with a lowermost portion, said pocket further comprising an outer extending flange integrally connected to said left side member and a back leading edge integrally connected to said right side member, said outer extending flange and said back leading edge each being placed atop and fixedly attached to said intermediate backing member.

7. An assembly as set forth in claim 6, wherein said pocket comprises a frontal tapered member having a leading lower edge and being bounded on each side thereof by said right and left side members each having bottom ends and a pitched opening structurally formed in part by the angular orientation of said left side member relative to said right side member.

8. An assembly as set forth in claim 7, wherein said pocket is fabricated from a unified piece of material having a leading edge and selectively formed to distinctly define said frontal tapered member, said right and left side members and said outer extending flange.

9. An assembly as set forth in claim 8, wherein said leading edge of the intermediate backing member and a portion of said leading edge of the unified piece of material comprise an edge treatment.

10. An assembly as set forth in claim 8, wherein said unified piece of material is constructed from a heavy-weighted material to retain the distinct shape of said frontal tapered member, said right and left side members and said outer extending flange.

11. An assembly as set forth in claim 10, wherein said heavy-weighted material is covered with fabric aesthetically corresponding to the material of construction used for the garment, said intermediate backing member, and said flexible backing member.

12. An assembly as set forth in claim 7, further comprising a base member positionally orientated opposite said pitched opening and having a leading edge fixedly attached to said lowermost portion of the leading edge of the intermediate backing member, to said leading lower edge of the frontal tapered member and to said bottom ends of the right and left side members.

13. An assembly as set forth in claim 1, wherein said flexible backing member comprises an outer leading edge folded in an underlying manner to engage with said inner facing surface to mitigate occurrences of unraveling and fraying of said outer leading edge.

14. An assembly as set forth in claim 1, wherein said flexible backing member comprises at least five sides of unequal length to further permit said flexible backing member to evenly conform to the specific shape and contours of the garment without appreciable buckling.

15. A holster assembly for holding a non-lethal weapon on a garment, said assembly comprising, in combination:

a flexible backing member having an outer mountable surface and an inner facing surface positionally orientated to engage with the garment, said outer mountable surface comprising an apex section having a snap button fixedly attached thereto;

an intermediate backing member being positioned atop of said outer mountable surface and fixedly attached to said flexible backing member;

a rigid sleeve having back and front sides integrally connected to first and second sideward members to collectively form a receptacle for receiving therein the non-lethal weapon, said first sideward member comprising a snap button;

a pocket having a frontal tapered member bounded on each side thereof by left and right side members each being fixedly attached to said intermediate backing member to collectively yield a geometric configuration substantially suited for receiving therein said rigid sleeve;

a shortened sleeve strap having a first end fixedly attached to said right side member and a second end, said second end of the shortened sleeve strap having a mating snap button fixedly attached thereto to snappingly engage and mate with said snap button of the first sideward member; and a lengthened strap member having a first end fixedly attached to said outer mountable surface and a second end having a mating snap button fixedly attached thereto to snappingly engage and mate with said snap button of the apex section.

16. An assembly as set forth in claim 15, wherein said back side of the rigid sleeve comprises a mating snap button and said outer mountable surface comprises a snap button fixedly attached thereto to snappingly engage and mate with said mating snap button of the back side of the rigid sleeve.

17. An assembly as set forth in claim 15, wherein said second end of the lengthened strap member further comprises a strap release having a hook-and-loop fastener attached thereto and said apex section of the outer mountable surface further comprises a hook-and-loop fastener to lock and engage with said hook-and-loop fastener of the second end of the lengthened strap member.

18. An assembly as set forth in claim 17, wherein said rigid sleeve comprises a tapered end section, an upper slanted opening for accepting and passing therethrough the non-lethal weapon, and a locking mechanism situated in vicinity of said shortened sleeve strap for securing the non-lethal weapon within said rigid sleeve.

19. A holster assembly for holding a non-lethal weapon on a garment, said assembly comprising, in combination:

a flexible backing member having an outer mountable surface and an inner facing surface positionally orientated to engage with the garment, said outer mountable surface comprising first and second snap buttons fixedly attached thereto;

an intermediate backing member being positioned atop of said outer mountable surface and sewingly attached to said flexible backing member, said intermediate backing member having a leftward perimeter portion and a leading edge with a lowermost portion;

a rigid sleeve having back and front sides integrally connected to first and second sideward members to collectively form a receptacle for receiving therein the non-lethal weapon and a locking mechanism for securing the non-lethal weapon within said receptacle, said back side comprising a mating snap button to snappingly engage and mate with said first snap button of the outer mountable surface, said first sideward member comprising a snap button mounted in vicinity of said locking mechanism;

a pocket of unified construction having a frontal tapered member bounded on each side thereof by right and left side members each having a bottom end and being sewingly attached to said intermediate backing member to collectively yield a geometric configuration substantially suited for receiving therein said rigid sleeve, said frontal tapered member having a leading lower edge;

a shortened sleeve strap having a first end fixedly attached to said right side member and a second end, said second end of the shortened sleeve strap having a mating snap button fixedly attached thereto to snappingly engage and mate with said snap button of the first sideward member of the rigid sleeve;

a lengthened strap member having a first end fixedly attached to said outer mountable surface and a second end, said second end of the lengthened strap member having a strap release and a mating snap button fixedly attached thereto to snappingly engage and mate with said second snap button of the outer mountable surface; and a base member having a leading edge sewingly attached to said lowermost portion of the leading edge of the intermediate backing member, to said leading lower edge of the frontal tapered member, and to said bottom ends of the right and left side members.

20. An assembly as set forth in claim 19, wherein said flexible backing member comprises at least five sides of unequal length to further permit said flexible backing member to evenly conform to the specific shape and contours of the garment without appreciable buckling and an outer leading edge folded in an underlying manner to engage with said inner facing surface to mitigate occurrences of unraveling and fraying of said outer leading edge.

* * * * *